US006305537B1

(12) United States Patent
Jaffe

(10) Patent No.: US 6,305,537 B1
(45) Date of Patent: Oct. 23, 2001

(54) CAMERA CARRYING CASE

(75) Inventor: Lisa W. Jaffe, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/578,385

(22) Filed: May 25, 2000

(51) Int. Cl.[7] ..... B65D 85/38
(52) U.S. Cl. ..... 206/316.2; 224/908
(58) Field of Search ..... 206/305, 316.2; 383/118; 150/154, 165; 224/908, 909

(56) References Cited

U.S. PATENT DOCUMENTS

| | | | | |
|---|---|---|---|---|
| D. 276,761 | | 12/1984 | Lang . | |
| D. 381,902 | | 8/1997 | Chapman et al. . | |
| 2,136,357 | | 11/1938 | Darling et al. . | |
| 2,323,053 | | 6/1943 | Kupferschmid . | |
| 2,565,006 | | 8/1951 | Trickey . | |
| 3,276,671 | * | 10/1966 | Fleitman | 383/118 |
| 3,731,586 | * | 5/1973 | Meazza | 206/316.2 |
| 3,813,017 | * | 5/1974 | Pimsieur | 224/908 |
| 3,835,905 | * | 9/1974 | Spruyt et al. | 206/316.2 |
| 4,549,589 | | 10/1985 | Nguyen . | |
| 4,917,241 | | 4/1990 | Hanson . | |
| 4,923,060 | | 5/1990 | Breslau . | |
| 5,101,974 | | 4/1992 | Alwitt . | |

* cited by examiner

*Primary Examiner*—David T. Fidel
(74) *Attorney, Agent, or Firm*—Roger A. Fields

(57) ABSTRACT

A camera carrying case includes a sleeve having a camera receiving hollow and a pair of opposite open ends that are individually configured to permit camera insertion into the hollow. A pair of spaced elastic expandable strips between the open ends each interconnect a pair of spaced longitudinal edge portions of the sleeve to permit the hollow to be enlarged to accommodate different size cameras and to form a pocket between the elastic expandable strips for receiving various articles. A flap is connected to one of the longitudinal edge portions to wrap about the sleeve, but not about the elastic expandable strips, and to unwrap from about the sleeve.

7 Claims, 6 Drawing Sheets

CAMERA CARRYING CASE

FIELD OF THE INVENTION

The invention relates generally to the field of photography, and in particular to a camera carrying case.

BACKGROUND OF THE INVENTION

Cases intended for modern hand-held cameras, such as the 35-mm format, are designed to provide good protection for the camera without being uncomfortable to carry or inviting attention. Some are designed to retain the camera by means of a screw that attaches the bottom of the case to a tripod socket in the bottom of the camera. Other cases retain the camera by means of a short strap such as in prior art U.S. Pat. No. 2,565,006 issued May 29, 1950, and No. Des. 276,761 issued Dec. 18, 1984.

SUMMARY OF THE INVENTION

A camera carrying case comprising:

a sleeve including front, rear and top integral portions that form a camera receiving hollow, an open bottom between the front and rear portions, and at least one open end configured to permit camera insertion into the hollow; and at least one elastic expandable bottom strip interconnecting the front and rear portions across the open bottom to permit the hollow to be enlarged to accommodate different size cameras.

DETAILED DESCRIPTION OF THE INVENTION

The invention is disclosed as being embodied preferably in a camera carrying case. Because the features of a camera carrying case are generally known, the description which follows is directed in particular only to those elements forming part of or cooperating directly with the disclosed embodiment. It is to be understood, however, that other elements may take various forms known to a person of ordinary skill in the art.

Figure 1:
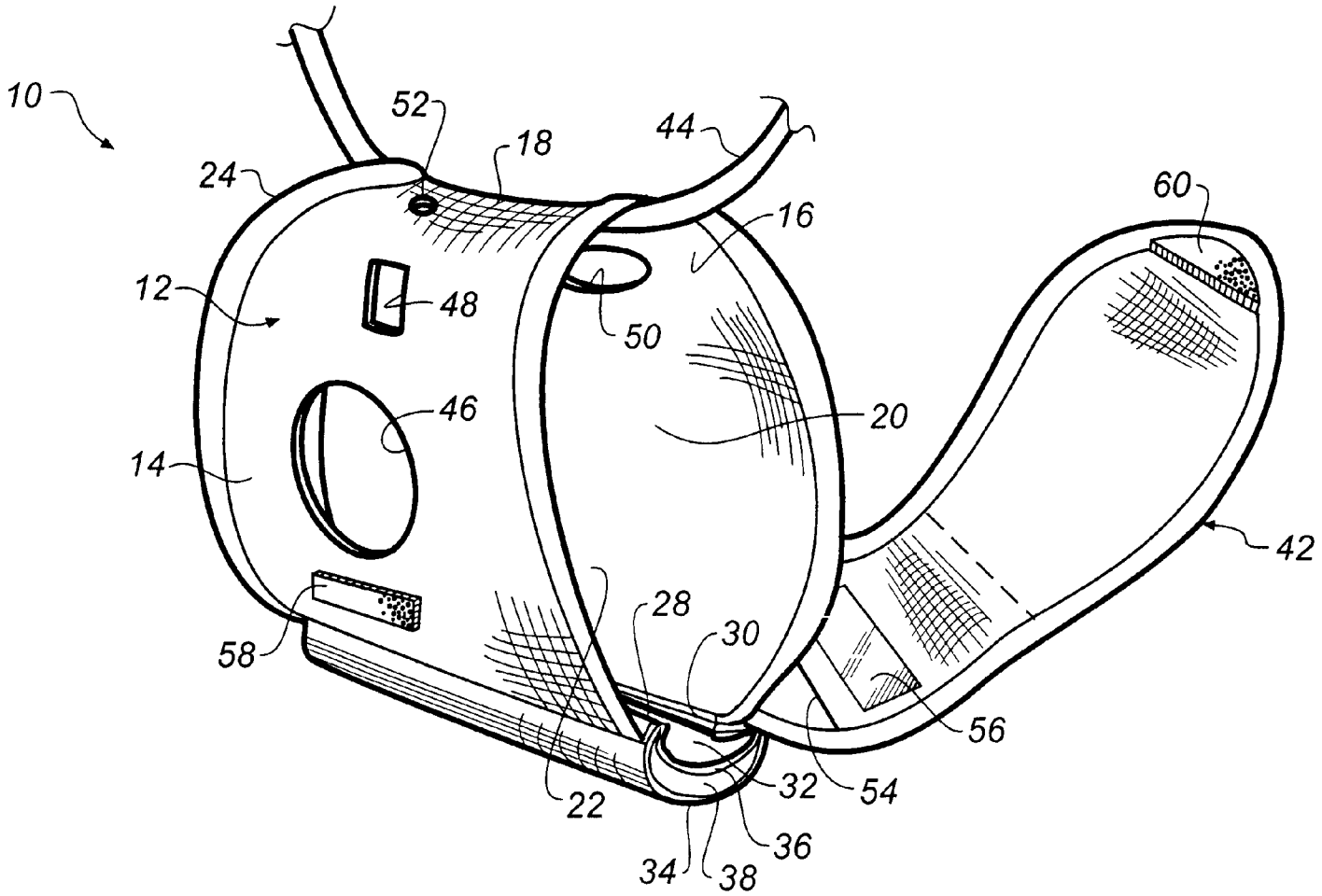
FIG. 1 is a front, top perspective view of a camera carrying case according to a preferred embodiment of the invention, showing a flap unwrapped from about a sleeve.
Figure 2:
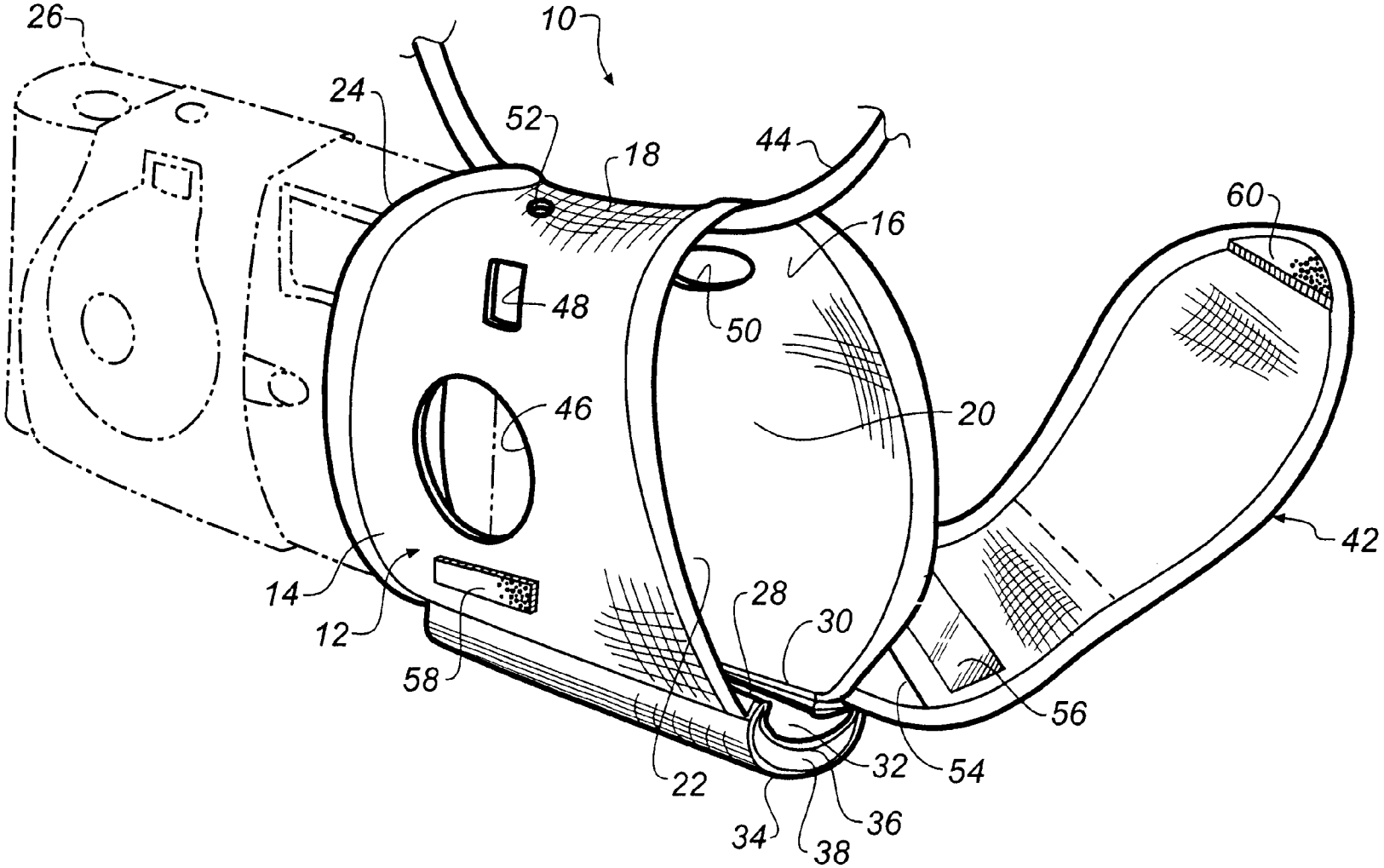
FIG. 2 is a front, top perspective view of the camera carrying case, similar to FIG. 1, and showing camera insertion into a hollow of the sleeve.
Figure 3:
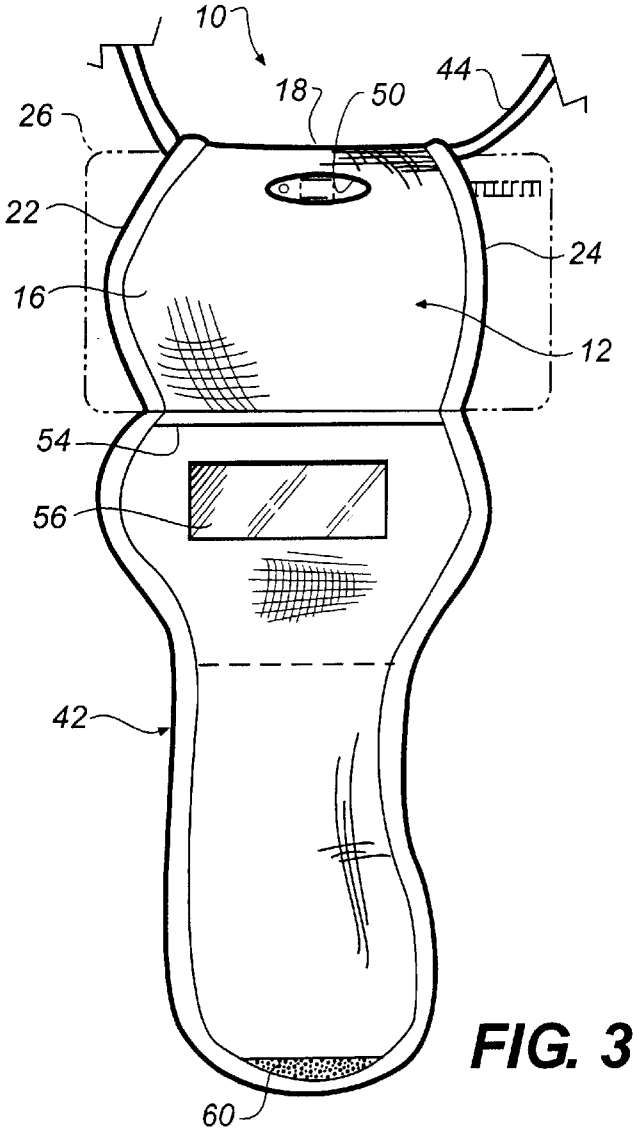
FIG. 3 is a rear elevation view of the camera carrying case as shown in FIG. 2.
Figure 4:
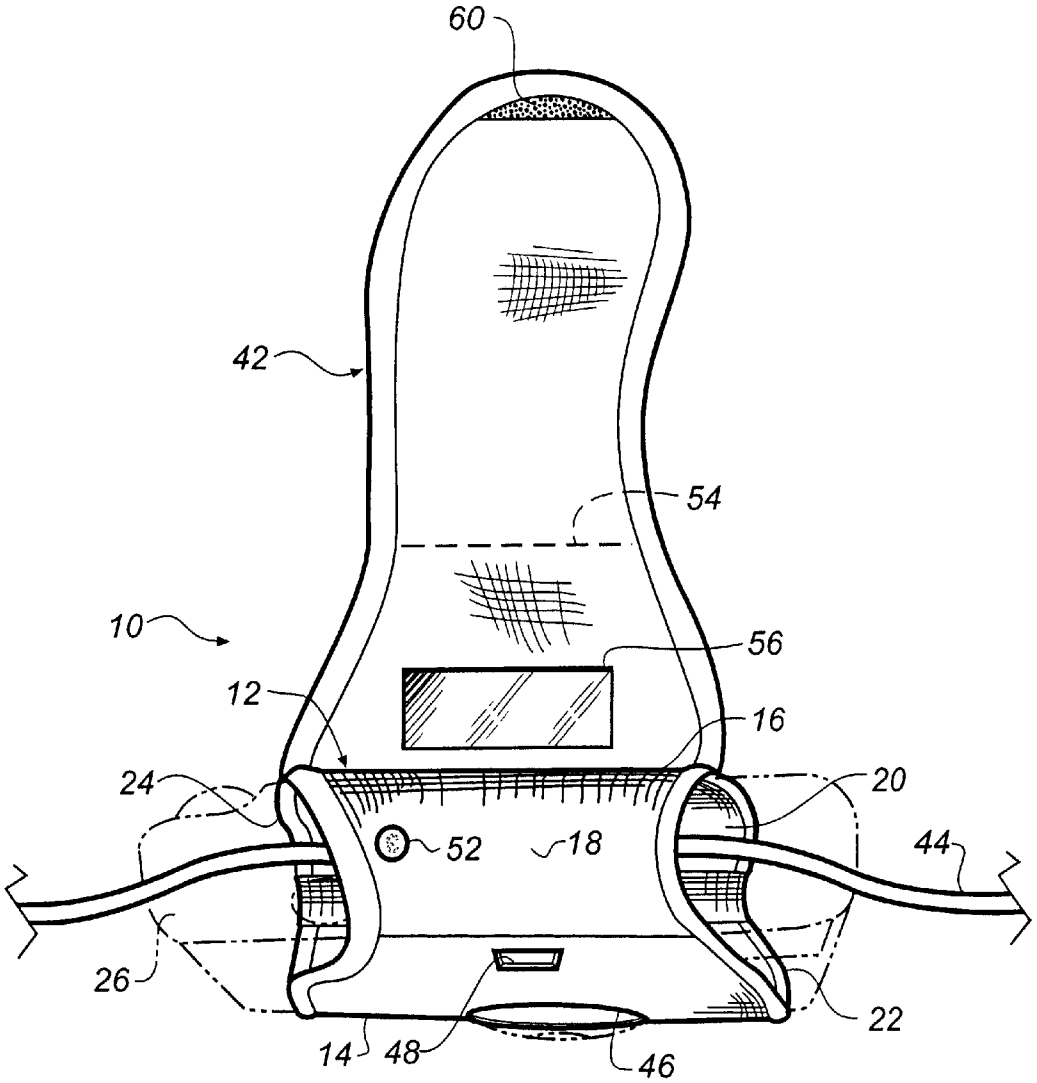
FIG. 4 is a top plan view of the camera carrying case as shown in FIG. 2.
Figure 5:
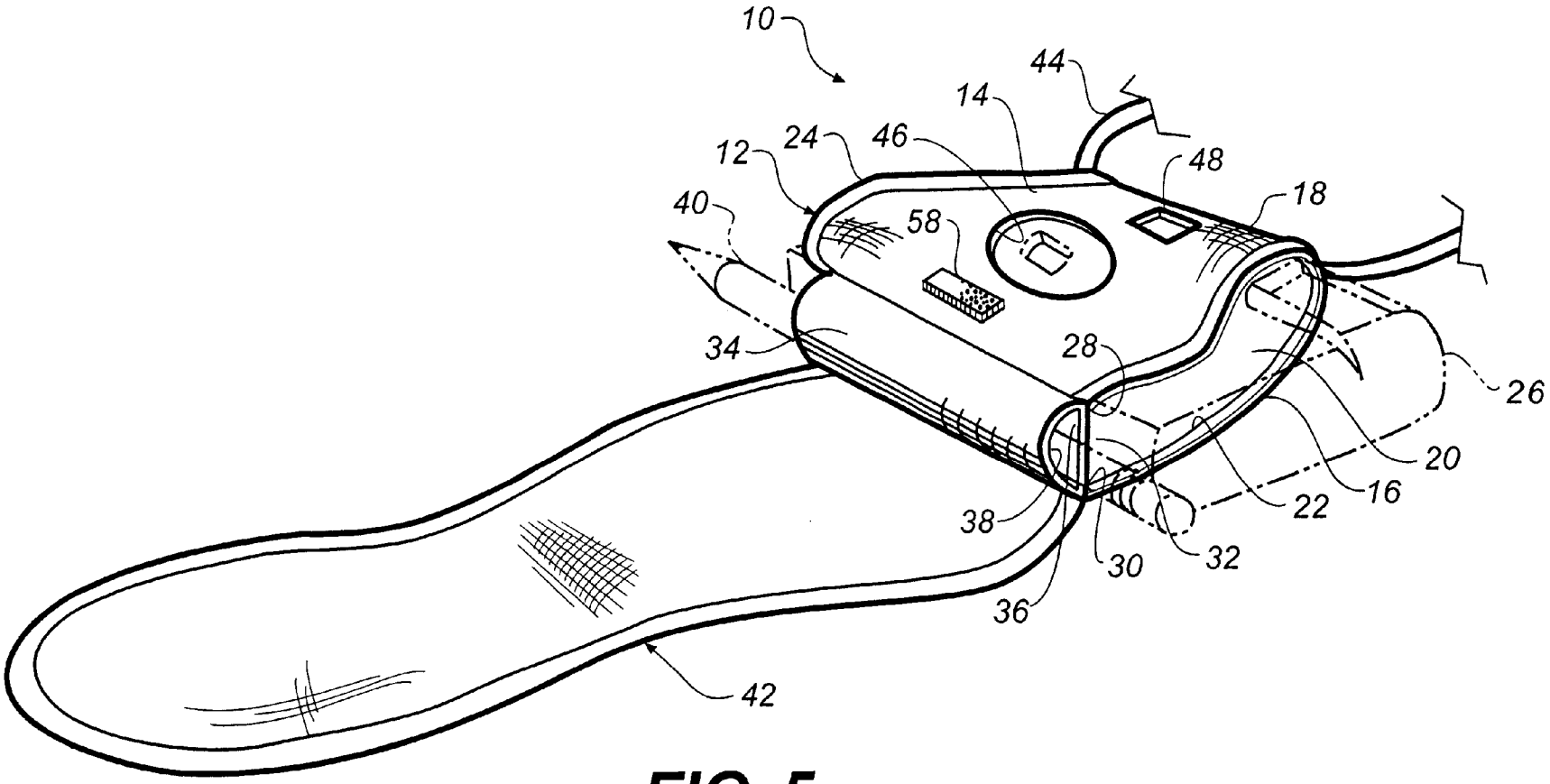
FIG. 5 is a front, bottom perspective view of the camera carrying case, showing the flap unwrapped from about the sleeve.
Figure 6:
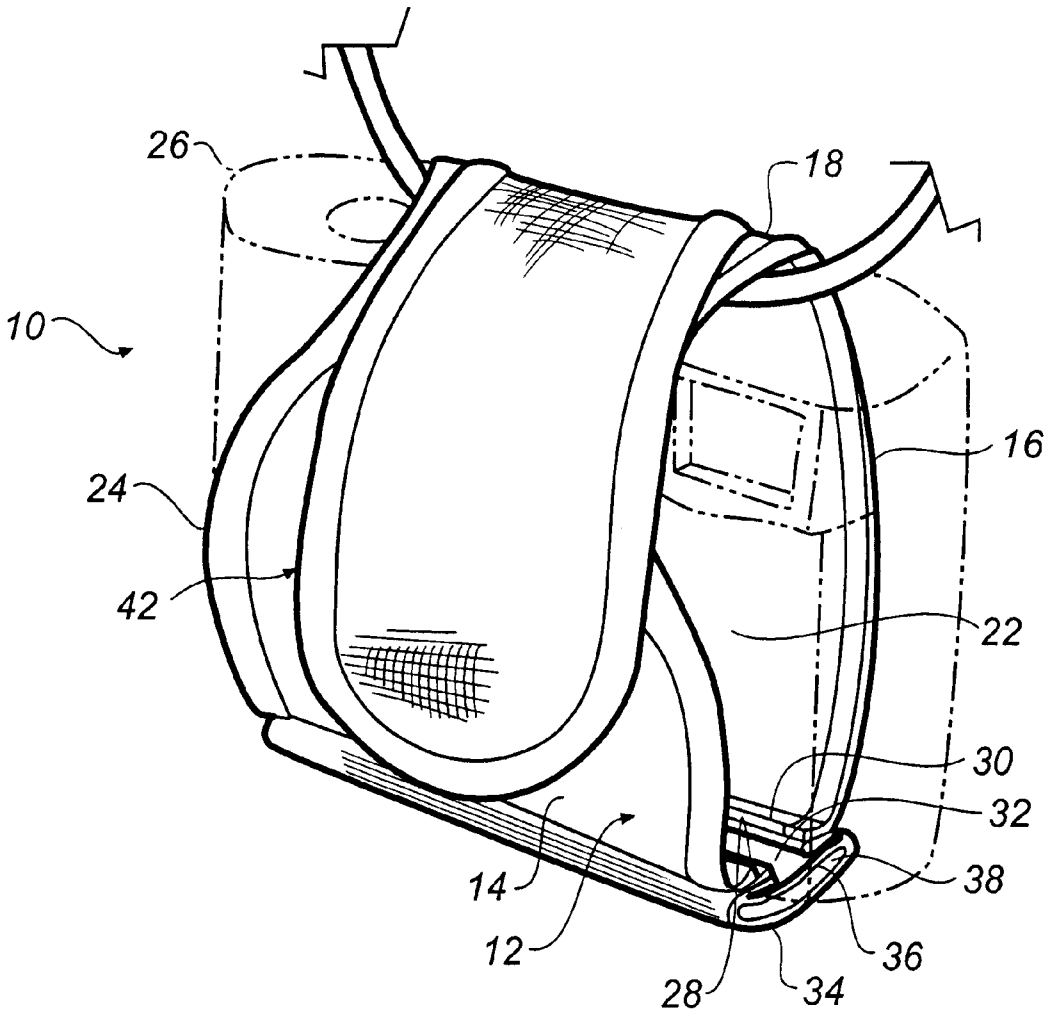
FIG. 6 is a front, top perspective view of the camera carrying case, showing the flap wrapped from about the sleeve.

Referring now to the drawings, FIGS. 1–6 show a camera carrying case 10 with a sleeve 12 including front, rear and top integral portions 14, 16 and 18 that form a camera receiving hollow 20, and including a pair of opposite open ends 22 and 24 that are individually configured to permit manual insertion of a camera 26 into the hollow as shown in FIG. 2. The front and rear portions 14 and 16 have respective parallel longitudinal edge portions 28 and 30, separated by an open bottom 32 of the sleeve 12. A pair of spaced elastic expandable strips 34 and 36 between the open ends 22 and 24, each interconnect the spaced longitudinal edge portions 28 and 30 to permit the hollow 20 to be enlarged to accommodate different size cameras (by expanding the strips widthwise) and to form a pocket 38 between the strips for receiving various articles such as the pencil 40 shown in FIG. 5. A flap 42 is connected to the longitudinal edge portion 30 to wrap about the sleeve 12, but not about the strips 34 and 36, as shown in FIG. 6, and to unwrap from about the sleeve as shown in FIGS. 3 and 4. A shoulder-length strap 44 longitudinally extends from beneath the top portion 18 to protrude from the hollow 20 at the opposite ends 22 and 24. The strap 44 is secured to the top portion 18.

The front portion 14 has a taking lens opening 46 and a front viewfinder opening 48. The rear portion 16 has a rear viewfinder opening 50 aligned with the front viewfinder opening 48. The top portion 18 has an exposure counter opening 52.

The flap 42 has a pocket 54 for receiving various articles, and a mirror 56. See FIGS. 1–4. When the flap 42 is wrapped about the sleeve 12, it covers the taking lens opening 46, the front viewfinder opening 48, the rear viewfinder opening 50, and the exposure counter opening 52.

The sleeve 12 and the flap 42 have known hook and loop pads 58 and 60 commonly referred to as "Velcro" that engage when the flap is wrapped about the sleeve.

The invention has been described with reference to a preferred embodiment. However, it will be appreciated that variations and modifications can be effected by a person of ordinary skill in the art without departing from the scope of the invention.

PARTS LIST

10. camera carrying case
12. sleeve
14. frontportion
16. rear portion
18. top portion
20. camera receiving hollow
22. open end
24. open end
26. camera
28. longitudinal edge portion
30. longitudinal edge portion
32. open bottom
34. strip
36. strip
38. pocket
40. pencil
42. flap
44. strap
46. taking lens opening
48. front viewfinder opening
50. rear viewfinder opening
52. exposure counter opening
54. pocket
56. mirror
58. hook pad
60. loop pad

What is claimed is:

1. A camera carrying case comprising:

a sleeve having a camera receiving hollow and a pair of opposite open ends each configured to permit camera insertion into said hollow;

at least one elastically expandable strip interconnecting a pair of spaced longitudinal edge portions of said sleeve to permit said hollow to be enlarged to accommodate different size cameras; and a flap connected to said sleeve to wrap about said sleeve, but not about said at least one elastically expandable strip, and to unwrap from about said sleeve.

2. A camera carrying case as recited in claim 1, wherein said flap has a pocket for receiving various articles.

3. A camera carrying case as recited in claim 1, wherein said flap includes a mirror.

4. A camera carrying case as recited in claim 1, wherein said sleeve includes a front portion having a taking lens opening and a front viewfinder opening, a rear portion having a rear viewfinder opening aligned with said front viewfinder opening, and a top portion integral with said front and rear portions and having an exposure counter opening.

5. A camera carrying case comprising:

a sleeve having a camera receiving hollow and a pair of opposite open ends each configured to permit camera insertion into said hollow, and including a front portion having a taking lens opening, a rear portion, and top portion integral with said front and rear portions;

at least one elastically expandable strip interconnecting a pair of spaced longitudinal edge portions of said sleeve to permit said hollow to be enlarged to accommodate different size cameras; and a strap longitudinally extending from beneath said top portion to protrude from said hollow at said opposite ends.

6. A camera carrying case comprising:

a sleeve having a camera receiving hollow and a pair of opposite open ends each configured to permit camera insertion into said hollow; and a pair of spaced elastic expandable strips between said open ends that each interconnect a pair of spaced longitudinal edge portions of said sleeve to permit said hollow to be enlarged to accommodate different size cameras and to form a pocket between said elastic expandable strips for receiving various articles.

7. A camera carrying case as recited in claim 6, wherein a flap is connected to one of said longitudinal edge portions to wrap about said sleeve, but not about said elastic expandable strips, and to unwrap from about said sleeve.

* * * * *